US007169096B1

(12) United States Patent
Vittone et al.

(10) Patent No.: US 7,169,096 B1
(45) Date of Patent: Jan. 30, 2007

(54) ABDOMINAL EXERCISE MACHINE

(75) Inventors: Suzanne R. Vittone, Hurley, WI (US); Larry W. Vittone, Hurley, WI (US); William M. Vittone, Oak Ridge, TN (US)

(73) Assignee: Vitex, LLC, Oak Ridge, TN (US)

( * ) Notice: Subject to any disclaimer, the term of this patent is extended or adjusted under 35 U.S.C. 154(b) by 0 days.

(21) Appl. No.: 11/115,864

(22) Filed: Apr. 27, 2005

Related U.S. Application Data

(60) Provisional application No. 60/584,245, filed on Jun. 30, 2004.

(51) Int. Cl.
*A63B 26/00* (2006.01)

(52) U.S. Cl. ..... 482/140; 482/92; 482/93; 482/94; 482/95

(58) Field of Classification Search ..... 482/140, 482/142, 148, 95–97; D21/662, 665, 676, D21/686, 690
See application file for complete search history.

(56) References Cited

U.S. PATENT DOCUMENTS 4,240,626 A * 12/1980 Lambert, Jr. ..... 482/100
4,564,193 A 1/1986 Stewart
4,582,319 A 4/1986 Luna
4,725,057 A 2/1988 Shifferaw
5,147,259 A * 9/1992 Hutchins ..... 482/101
5,599,261 A 2/1997 Easley et al.
6,645,129 B2 * 11/2003 Eschenbach ..... 482/140

* cited by examiner

*Primary Examiner*—Lori Amerson
(74) *Attorney, Agent, or Firm*—Luedeka, Neely & Graham PC

(57) ABSTRACT

An abdominal exercise machine includes a bench assembly having a frame and a user support supported by the frame and configured for having a user lie thereupon, a weight assembly adjacent the bench assembly and having a weight carriage movably positionable thereon, a bar for engaging the legs of the user adjacent thigh and shin areas of the legs; and a cable passing through a plurality of pulleys and having a first end connected to the weight assembly and operably associated with the weight carriage for urging the weight carriage in a desired direction and a second end connectable to the bar.

6 Claims, 9 Drawing Sheets

ABDOMINAL EXERCISE MACHINE

CROSS-REFERENCE TO RELATED APPLICATION

This application claims benefit to U.S. provisional application Ser. No. 60/584,245 filed Jun. 30, 2004, and entitled ABDOMINAL EXERCISE MACHINE, incorporated herein by reference in its entirety.

FIELD OF THE INVENTION

This invention relates generally to exercise devices. More particularly, this invention relates to exercise devices for exercising abdominal muscles.

BACKGROUND AND SUMMARY OF THE INVENTION

Improvement is desired in the configuration of machines designed for exercising abdominal muscles. In this regard, the present invention relates to an improved abdominal exercise machine.

In a preferred embodiment, the abdominal exercise machine includes a bench assembly having a frame and a user support supported by the frame and configured for having a user lie thereupon, and a weight assembly adjacent the bench assembly and having a weight carriage movably positionable thereon. A bar is provided for engaging the legs of the user adjacent thigh and shin areas of the legs.

A cable passes through a plurality of pulleys and has a first end connected to the weight assembly and operably associated with the weight carriage for urging the weight carriage in a desired direction and a second end connectable to the bar.

The configuration of the device facilitates exercises for strengthening abdominal muscles and permits freedom of movement during such exercise for enhanced comfort and benefits.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1A:
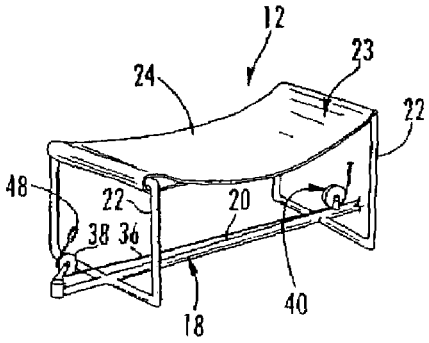
FIG. 1A is a perspective view of a bench assembly portion of an abdominal exercise device in accordance with the invention.
Figure 1B:
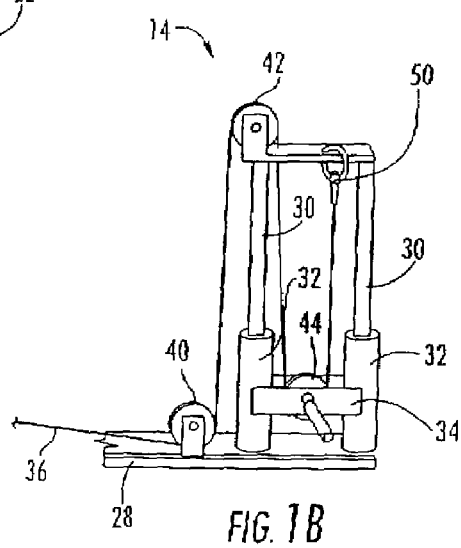
FIG. 1B is a side view of a weight assembly that cooperates with the bench assembly.
Figure 2:
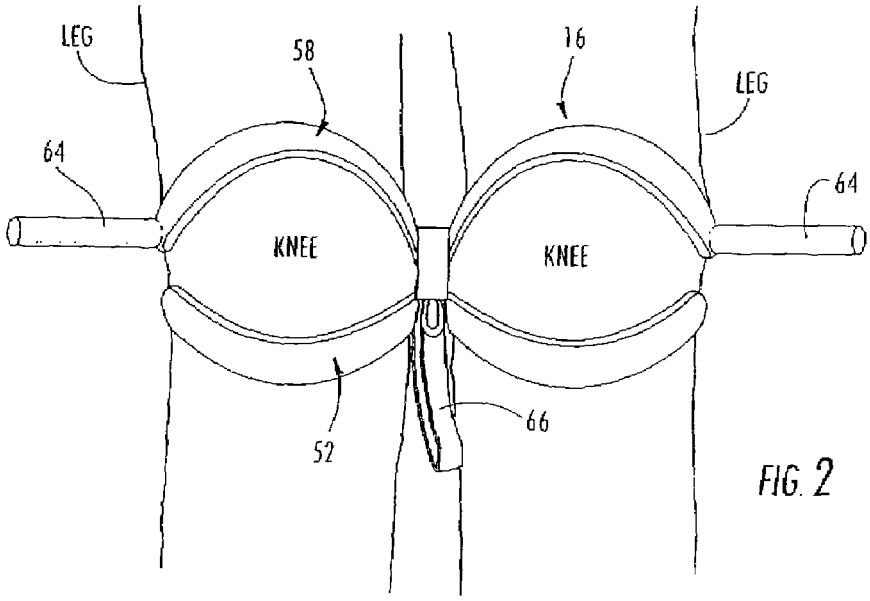
FIG. 2 is a front view of a bar for use with the abdominal exercise device of the invention.
Figure 3:
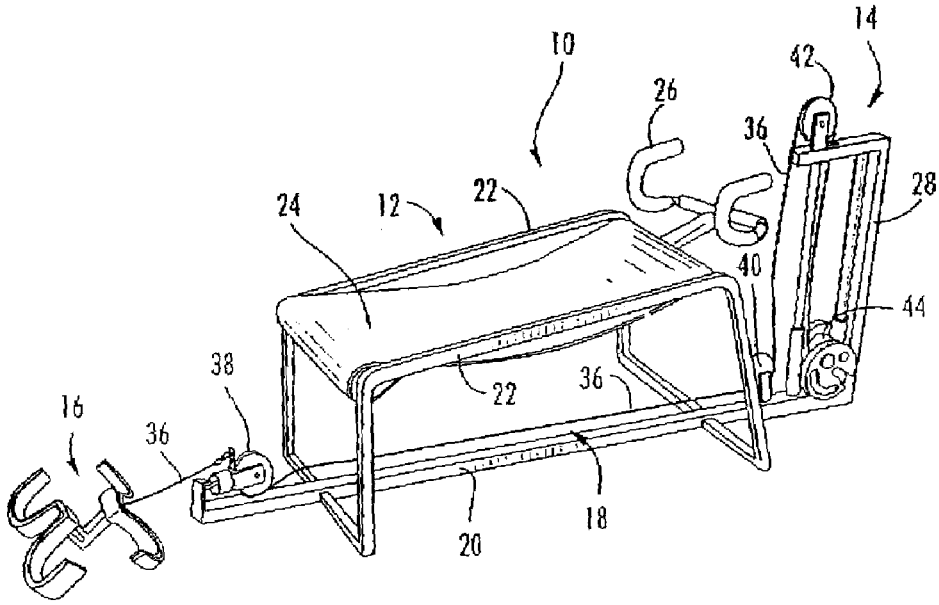
FIG. 3 is a perspective view of a fully assembled abdominal exercise device incorporating the bench assembly of FIG. 1A, the weight assembly of FIG. 1B, and the bar of FIG. 2.

With reference to FIGS. 1–4, the invention relates to an abdominal exercise machine 10 that is particularly suitable for performing exercises in conjunction with weights for exercising the abdominal muscles of a user. In a preferred embodiment, the machine 10 includes a bench assembly 12, a weight assembly 14, and a bar 16.

The bench assembly 12 preferably includes a frame 18 having a base member 20, upright members 22, and a user support 23. The user support 23 may preferably be provided by a flexible sheet material 24, such as cloth or nylon, supported by the upright members 22. A handlebar 26 may be attached to the frame 18 for the user to grasp during exercise.

Figure 4:
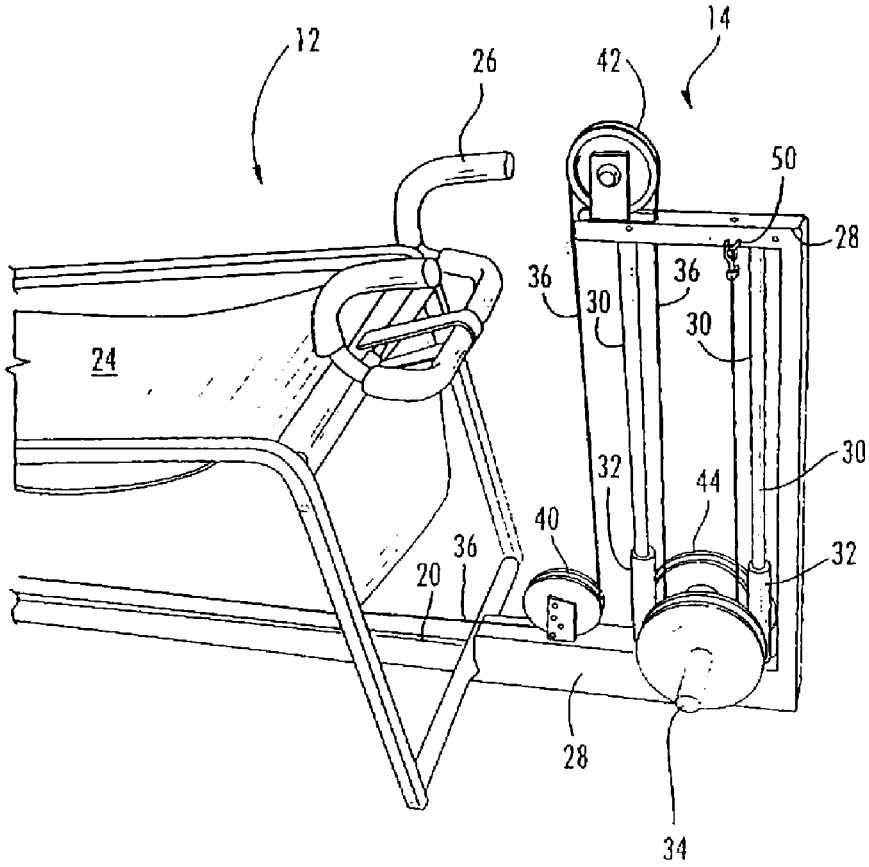
FIG. 4 is a detailed view of the weight assembly of the exercise device of FIG. 3.

The weight assembly 14 is configured for supporting and guiding movement of weight or other resistance to provide resistance to exercise movement of the user. In a preferred embodiment, the weight assembly 14 is configured to guide vertical movement of weight and includes a frame 28, a pair of upstanding rods 30 supported by the frame 28, a pair of slides 32 for sliding along the rods 30, and a weight carriage 34 connected to the slides 32. It is preferred that the frame 28 of the weight assembly 14 rigidly connect to the frame 18 of the bench assembly 12, as best seen in FIG. 4. It will be appreciated that the weight assembly may be configured to incorporate alternative resistance devices, such as springs, shock absorbers, and the like, and be configured other than vertically.

Figure 5:
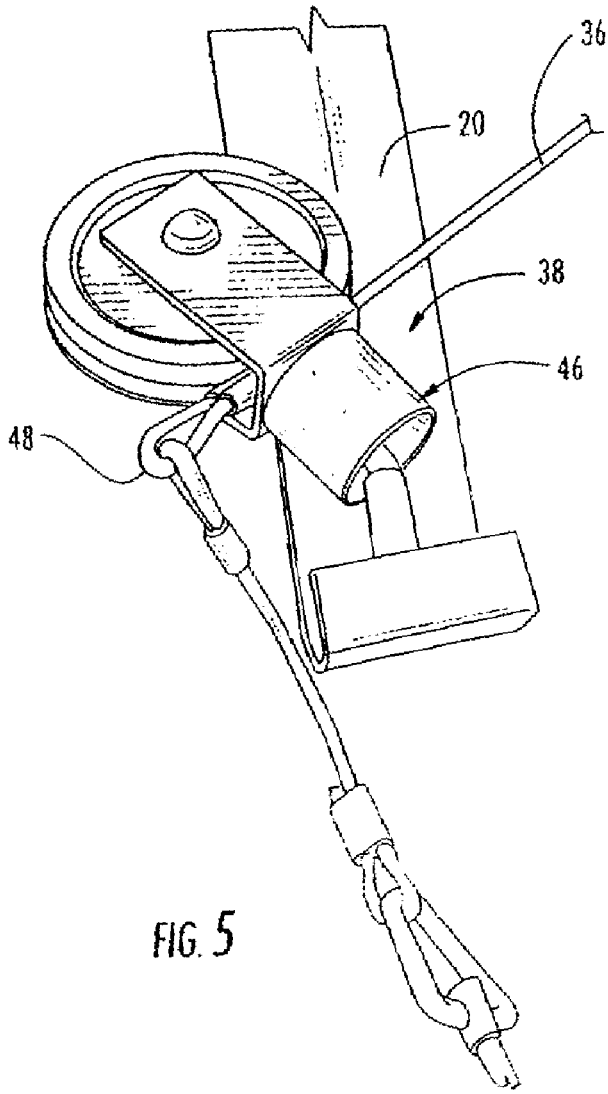
FIG. 5 shows a ball joint pulley component of the exercise device of FIG. 3.
Figure 6:
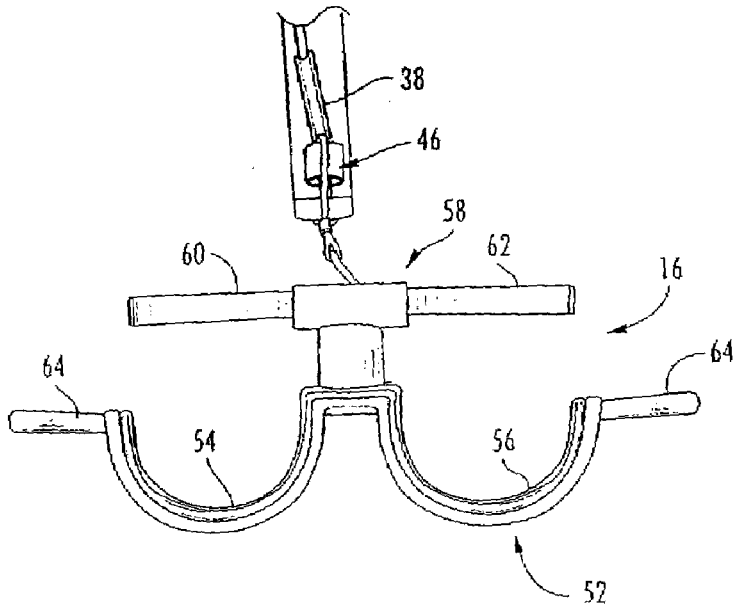
FIGS. 6 and 7 show a bar component of the exercise device of FIG. 3.
Figure 7:
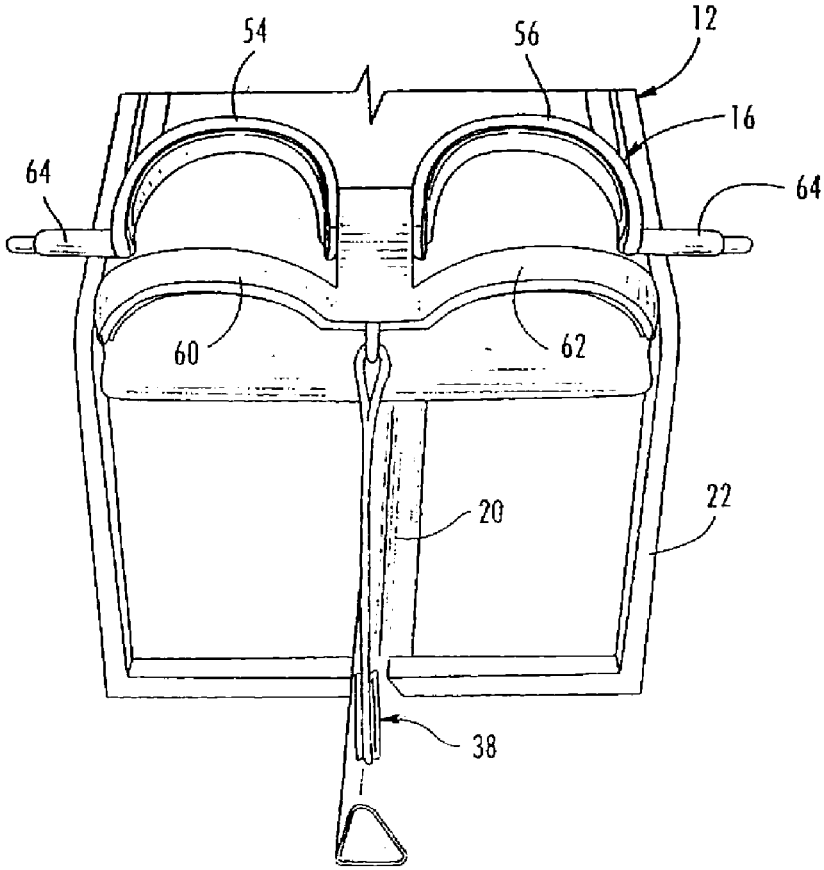

A cable 36 extends around a pulley 38 on the bench assembly 12, and around a pair of pulleys 40 and 42 on the weight assembly 14 and a pulley 44 on the weight carriage 34. The pulley 38 is preferably able to swivel or pivot relative to the frame 18, and is preferably mounted to the frame 18 via a pivot member such as a universal or ball joint 46 or the like (FIG. 5). One end 48 of the cable 36 is free (adjacent the pulley 38) and preferably includes a connector such as a loop for attachment of the bar 16. The other end 50 of the cable 36 is fixedly connected to the frame 28 of the weight assembly 14.

Figure 8:
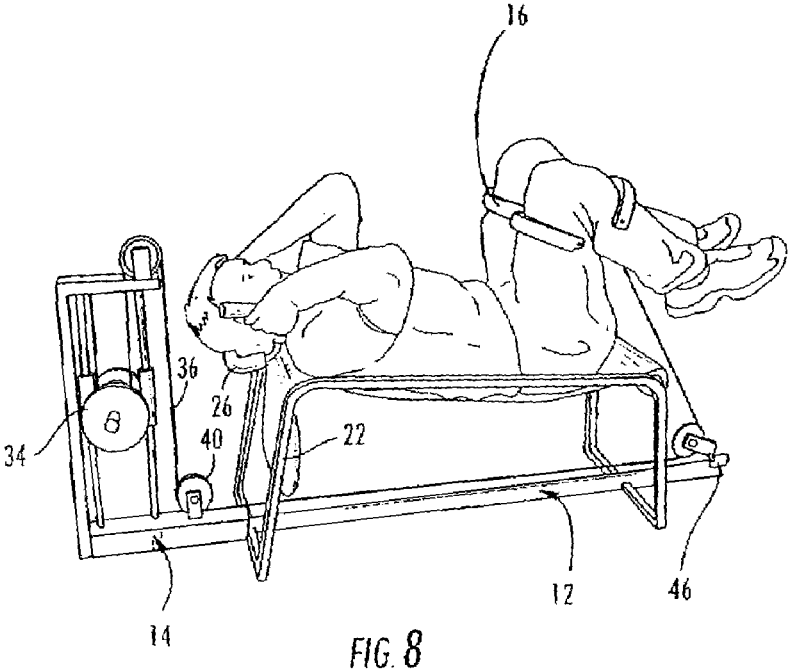
FIGS. 8 and 9 show a user performing exercises on the device of FIG. 3.
Figure 9:
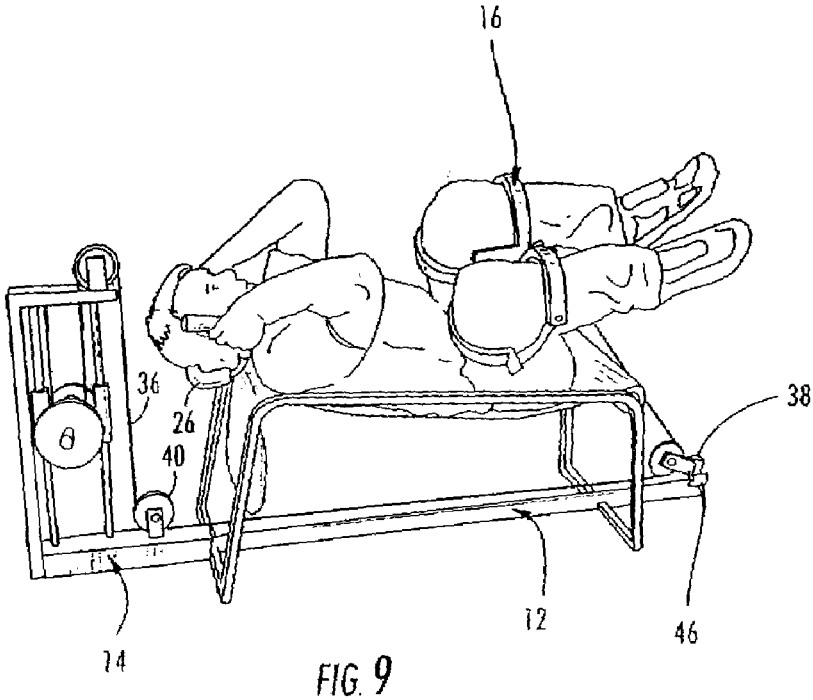

With reference to FIGS. 2 and 6–9, the bar 16 is configured for engaging the legs of a user above and below the knees so as to remain against the legs during exercise, such as when doing crunches or sit-up type movements as shown in FIGS. 8–9. In this regard, the bar 16 preferably includes a thigh engaging member 52 having a pair of U-shaped segments 54 and 56 configured for engaging the thighs, and a shin engaging member 58 having a pair of U-shaped segments 60 and 62 configured for engaging the shins. The thigh engaging member 52 also preferably includes mounts 64 at the ends thereof for receiving one or more free weights. If desired, straps having mating hook and loop material or other fastening structure may be provided on the bar 16 to help maintain the bar 16 on the legs of the user.

Returning to FIG. 2, the bar 16 may also preferably include a curved segment 66 that extends down from a central location of the shin engaging member 52 for providing a curved surface about which the cable 36 may contact. It has been observed that the curved segment facilitates exercise during an upper end of a knee raise exercise motion. That is, the cable 36 curves around the segment 66 during this motion and provides enhanced exercise benefits. As seen in FIGS. 8 and 9, the ball joint 46 enables the pulley 38 to swivel, so as to enable the user to swivel during exercise as may be desired for a particular exercise. This enhances the range of motion in which the user may perform exercises.

Figure 10:
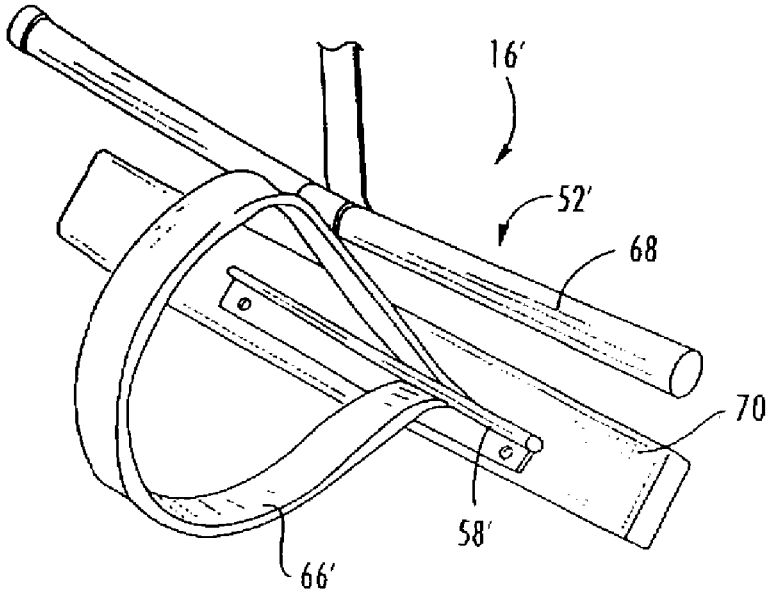
FIG. 10 shows an alternative embodiment of a bar component for use with the exercise device of FIG. 3.

With reference to FIG. 10, there is shown an alternate embodiment of a bar 16'. The bar 16' includes a thigh engaging member 52' provided by a bar 68, a shin engaging member 58' provided by a padded member 70, and a curved segment 66'.

To exercise using the machine 10, a user lies on the user support 23 so that the legs of the user are adjacent the end of the bench assembly 12 proximate the pulley 38. The bar 16 (or the bar 16') is engaged on the legs of the user and the user may act on the bar 16 (or 16') to pull on the cable 36.

For example, the user may do exercise motions in the nature of sit-ups, crunches, and the like which focus on exercising the abdominal muscles. These exercises also result in movement of the bar 16 or 16' which is connected to the cable 36. By the user performing an exercise which results in the cable 36 being pulled in a direction generally away from the pulley 38, the slides 32 are caused to be raised along the rods 30, thus raising one or more weights carried by the weight carriage 34. Likewise, when the cable 36 is allowed back toward the pulley 38, the weight carriage 34 is lowered.

The configuration also allows improved comfort and freedom of movement when performing sit-up or crunch type exercises, thus facilitating a variety of exercises. For example, as seen in FIGS. 8 and 9, the user is able to twist to a sideways position during exercise to yield increased range of motion during exercise.

The foregoing description of certain exemplary embodiments of the present invention has been provided for purposes of illustration only, and it is understood that numerous modifications or alterations may be made in and to the illustrated embodiments without departing from the spirit and scope of the invention.

The invention claimed is:

1. An abdominal exercise machine, comprising a bench assembly comprising a frame and a user support supported by the frame and configured for having a user lie thereupon, a weight assembly adjacent the bench assembly and having a weight carriage movably positionable thereon, a bar for engaging the legs of the user adjacent thigh and shin areas of the legs above and below the knees so as to remain against the legs during exercise; and a cable passing through a plurality of pulleys and having a first end connected to the weight assembly and operably associated with the weight carriage for urging the weight carriage in a desired direction and a second end connectable to the bar.

2. The exercise machine of claim 1, wherein the weight assembly is configured to guide vertical movement of weight and includes a frame, a pair of upstanding rods supported by the frame, a pair of slides for sliding along the rods, and a weight carriage connected to the slides.

3. The exercise machine of claim 1, wherein the bar includes a thigh engaging member configured for engaging the thighs of the user, and a shin engaging member configured for engaging the shins of the user.

4. The exercise machine of claim 3, wherein the bar further includes a curved segment that extends down from a central location of the shin engaging member for providing a curved surface about which the cable may contact.

5. The exercise machine of claim 3, wherein the thigh engaging member includes a pair of U-shaped segments configured for engaging the thighs of the user, and the shin engaging member includes a pair of U-shaped segments configured for engaging the shins of the user.

6. The exercise machine of claim 1, wherein one of the pulleys is pivotally connected to the frame.

* * * * *